US010704243B2

(12) United States Patent
Kashirajima et al.

(10) Patent No.: US 10,704,243 B2
(45) Date of Patent: Jul. 7, 2020

(54) FLUSH TOILET

(71) Applicant: TOTO LTD., Kitakyushu-shi, Fukuoka (JP)

(72) Inventors: Shu Kashirajima, Kitakyushu (JP); Makoto Bekki, Kitakyushu (JP); Hironori Yamasaki, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 15/914,708

(22) Filed: Mar. 7, 2018

(65) Prior Publication Data

US 2018/0282987 A1 Oct. 4, 2018

(30) Foreign Application Priority Data

Mar. 30, 2017 (JP) ..... 2017-068568

(51) Int. Cl.
*E03D 1/012* (2006.01)
*E03D 9/14* (2006.01)
(Continued)

(52) U.S. Cl.
CPC ..... *E03D 1/0125* (2013.01); *E03D 1/28* (2013.01); *E03D 5/01* (2013.01); *E03D 9/14* (2013.01);
(Continued)

(58) Field of Classification Search
CPC ..... E03D 1/0125; E03D 1/28; E03D 11/08; E03D 11/02; E03D 11/13; E03D 3/00; E03D 5/01; E03D 9/14; E03D 11/146
See application file for complete search history.

(56) References Cited

U.S. PATENT DOCUMENTS 771,098 A * 9/1904 Schmalmack ..... E03D 11/02 4/420
2,096,148 A * 10/1937 Vetrano ..... E03D 1/286 4/332
(Continued)

FOREIGN PATENT DOCUMENTS

DE 000941059 * 3/1956 ..... E03D 11/02
JP 5585944 B2 9/2014
TW 350892 B 1/1999

OTHER PUBLICATIONS

Machine translation of DE 941059. Espacenet. (Year: 2019).*
(Continued)

*Primary Examiner* — Erin Deery
(74) *Attorney, Agent, or Firm* — Studebaker & Brackett PC

(57) ABSTRACT

Disclosed is a flush toilet which comprises: a bowl portion having a waste-receiving surface and a rim provided along an upper edge of the waste-receiving surface; a drain trap conduit connected to the bowl portion to drain waste therethrough; a rim spout section including a rim spout port provided in a part of the rim located in a front region of the bowl portion for spouting the flush water, and a rim water-conducting passage provided to conduct flush water to the rim spout port; and a first water-conducting hose for supplying the flush water to the rim water-conducting passage located in the front region of the bowl portion, via beneath the waste-receiving surface, wherein the first water-conducting hose is configured to enable flush water to remain thereinside during stop of supply of the flush water.

4 Claims, 2 Drawing Sheets

(51) Int. Cl.

| | |
|---|---|
| ***E03D 11/08*** | (2006.01) |
| ***E03D 1/28*** | (2006.01) |
| ***E03D 5/01*** | (2006.01) |
| ***E03D 3/00*** | (2006.01) |
| ***E03D 5/10*** | (2006.01) |

(52) U.S. Cl.
CPC ..... *E03D 11/08* (2013.01); *E03D 3/00* (2013.01); *E03D 5/10* (2013.01)

(56) References Cited

U.S. PATENT DOCUMENTS

| | | | | |
|---|---|---|---|---|
| 2,979,731 | A * | 4/1961 | Reetz | E03D 1/28 4/432 |
| 3,005,993 | A * | 10/1961 | Corliss | E03D 5/016 4/317 |
| 5,502,845 | A * | 4/1996 | Hayashi | E03D 11/02 4/300 |
| 6,115,853 | A | 9/2000 | Shibata et al. | |
| 9,702,130 | B2 * | 7/2017 | Fukuya | E03D 5/01 |

OTHER PUBLICATIONS

An Office Action mailed by the Taiwanese Patent Office dated Jul. 13, 2018, which corresponds to Taiwanese Patent Application No. 106144691 and is related to U.S. Appl. No. 15/914,708.

* cited by examiner

FLUSH TOILET

TECHNICAL FIELD

The present invention relates to a flush toilet, and particularly to a flush toilet configured to cause swirling of flush water and discharge waste therefrom with the swirling flush water.

BACKGROUND ART

Heretofore, there has been known a flush toilet comprising a bowl portion having a front region in which a spout section capable of spouting flush water therefrom to form a swirl flow in the bowl portion is provided, whereby flush water spouted from the spout section swirls within the bowl portion, and waste is discharge therefrom with the swirling flush water. In this type of flush toilet, flush water is spouted from the spout section provided in the front region of the bowl portion, to thereby suppress energy loss in the front region having a curvature radius less than that in a rear region of the bowl portion, and maintain momentum of the swirl flow, so that it is possible to prevent insufficient cleaning of the bowl portion.

For example, in a flush toilet described in the Patent Document 1, flush water supplied from a water storage tank provided on an upper side of a rear portion of a toilet main unit passes through an inside of a rim provided along an upper edge of the bowl portion and reaches a rim spout port opened in a front region of the rim. Then, the flush water is spouted forwardly from the rim spout port to form a swirl flow in the bowl portion and discharge waste in the bowl portion with the swirl flow.

CITATION LIST

Patent Document

Patent Document 1: JP 5585944 B

SUMMARY OF INVENTION

Technical Problem

However, in the flush toilet described in the Patent Document 1, flush water is supplied from a rear side of the bowl portion to the rim spout port, so that it is necessary to form a rim water-conducting passage for conducting flush water to the rim spout port, inside the rim. This is likely to impose restrictions on flexibility in structural design and aesthetic design of the rim, and thus impose restrictions on flexibility in structural design and aesthetic design of the entire flush toilet.

Moreover, during the supply of flush water from the rear side of the bowl portion to the rim spout port, air inside the rim-water conducting passage is likely to be entrained by the flush water, thereby leading to occurrence of abnormal noise. As the rim water-conducting passage becomes longer, an amount of air thereinside becomes larger, and therefore the abnormal noise is more likely to occur. For example, in the case where the rim water-conducting passage extends from a rear region of the bowl portion to the rim spout port, via a part of the rim at a front end of the bowl portion, the length of the rim water-conducting passage is increased, so that the amount of air inside the rim water-conducting passage is increased, thereby leading to a problem that abnormal noise due to separation of air is more likely to occur.

The present invention has been made to solve the above problem, and an object thereof is to provide a flush toilet capable of suppressing an influence of the structure of a rim of a bowl portion on flexibility in structural design and aesthetic design of the entire flush toilet, and suppressing the occurrence of abnormal noise.

Solution to Technical Problem

In order to achieve the above object, the present invention relates to a flush toilet which discharge waste by causing swirling of flush water. The flush toilet comprises: a bowl portion having a bowl-shaped waste-receiving surface and a rim provided along an upper edge of the waste-receiving surface; a drain conduit connected to the bowl portion to drain waste therethrough; a rim spout section including a rim spout port provided in a part of the rim located in a front region of the bowl portion for spouting the flush water therefrom so as to cause the spouted flush water to swirl along the rim to thereby clean the bowl portion, and a rim water-conducting passage provided inside a part of the rim located in the front region of the bowl portion, to conduct flush water to the rim spout port; and a water-conducting passage member for supplying the flush water to the rim water-conducting passage located in the front region of the bowl portion, via beneath the waste-receiving surface, wherein the water-conducting passage member is configured to enable flush water to remain thereinside during stop of supply of the flush water.

In the flush toilet of the present invention having the above feature, the rim spout section comprising a rim spout port provided in a part of the rim located in the front region of the bowl portion for spouting flush water therefrom so as to cause the spouted flush water to swirl along the rim to thereby clean the bowl portion, and a rim water-conducting passage provided inside a part of the rim located in the front region of the bowl portion, to conduct the flush water to the rim spout port, and wherein the water-conducting passage member is configured to supply flush water to the rim water-conducting passage located in the front region of the bowl portion, via beneath the waste-receiving surface, and to enable the flush water to remain thereinside during stop of supply of the flush water, so that it is possible to shorten the length of the rim water-conducting passage and thus suppress restrictions on flexibility in structural design and aesthetic design of the rim. Therefore, it is possible to suppress an influence of the structure of the rim on flexibility in structural design and aesthetic design of the entire flush toilet. Further, shortening of the rim water-conducting passage makes it possible to reduce an amount of air inside the rim water-conducting passage and thereby suppress the occurrence of abnormal noise due to separation of air which has been entrained in flush water during a flushing operation.

Preferably, the flush toilet of the present invention further comprises: a water storage tank disposed on at least one of both sides of and/or beneath the drain conduit, to store flush water therein; and a booster pump for supplying the flush water stored in the water storage tank to the water-conducting passage member.

According to this feature, the water storage tank is disposed on at least one of both sides of and/or beneath the drain conduit which are typically an empty space, so that it is possible to enhance flexibility in structural design and aesthetic design of the entire flush toilet. Further, as compared to the case where the water storage tank is provided behind the bowl portion, the water storage tank can be disposed at a position closer to the rim water-conducting passage, so that it is possible to further shorten the water-conducting passage member, and thus suppress the occurrence of abnormal noise due to air inside the water-conducting passage member.

Preferably, the above flush toilet further comprises a drain socket for connecting an outlet of the drain conduit to an external pipeline, wherein the water storage tank is provided in integral relation with the drain socket.

According to this feature, the water storage tank is provided in integral relation with the drain socket for connecting the outlet of the drain conduit to the external pipeline, so that a clearance gap between the water storage tank and the drain socket is reduced. Thus, it is possible to more effectively utilize an empty space located on at least one of both sides of and/or beneath the drain conduit, and enhance the flexibility in structural design and aesthetic design of the entire flush toilet.

Preferably, in the flush toilet of the present invention, the water-conducting passage member has a downstream end connected to a bottom of the rim water-conducting passage, wherein the water-conducting passage member is disposed to supply flush water into the rim water-conducting passage in an upward direction.

According to this feature, the downstream end of the water-conducting passage member is connected to the bottom of the rim water-conducting passage, and the water-conducting passage member is disposed to supply flush water into the rim water-conducting passage in an upward direction, so that air inside the rim water-conducting passage can be agitated by the flush water supplied from the water-conducting passage member. This makes it possible to more effectively suppress the occurrence of abnormal noise due to separation of air, in the rim water-conducting passage.

Effect of Invention

The flush toilet of the present invention can suppress an influence of the structure of the rim on flexibility in structural design and aesthetic design of the entire flush toilet, and suppress the occurrence of abnormal noise.

DESCRIPTION OF EMBODIMENTS

With reference to the drawings, a flush toilet according to one embodiment of the present invention will now be described.

First of all, a basic structure of the flush toilet according to this embodiment will be described based on FIGS. 1 and 2.

Figure 1:
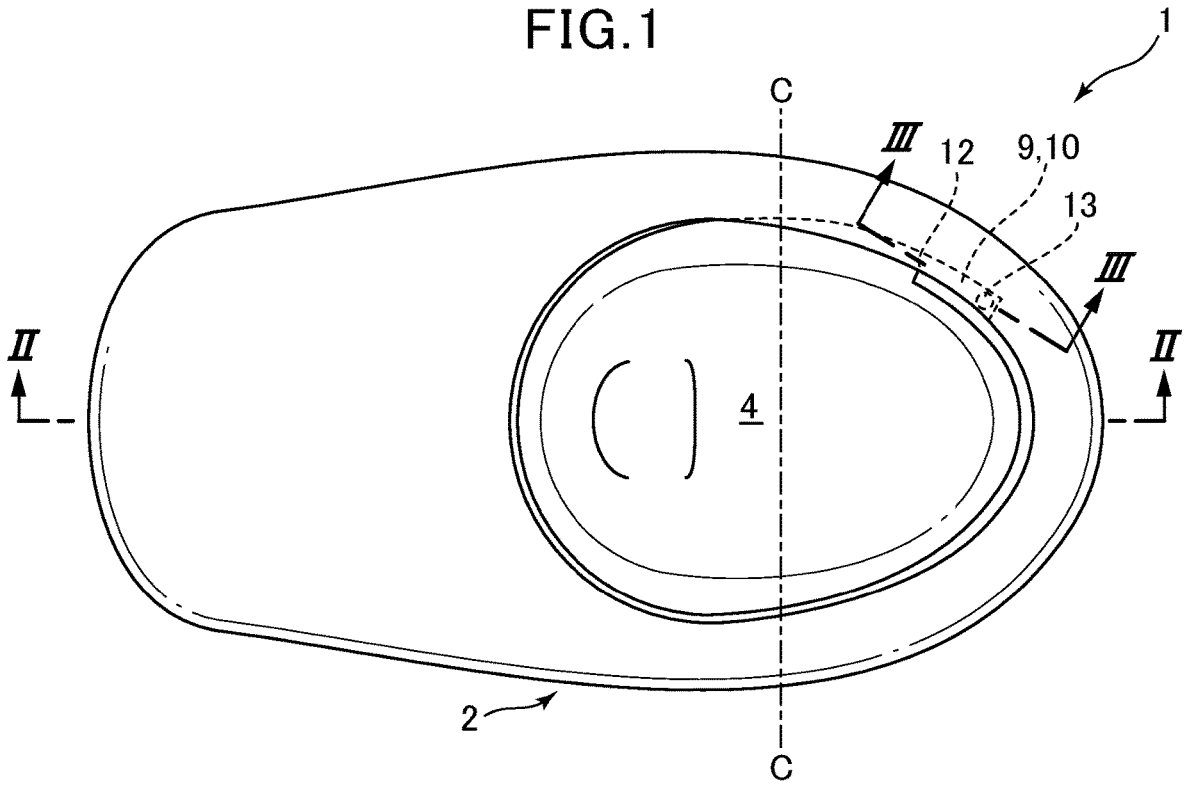
FIG. 1 is a top plan view depicting a flush toilet according to one embodiment of the present invention.
Figure 2:
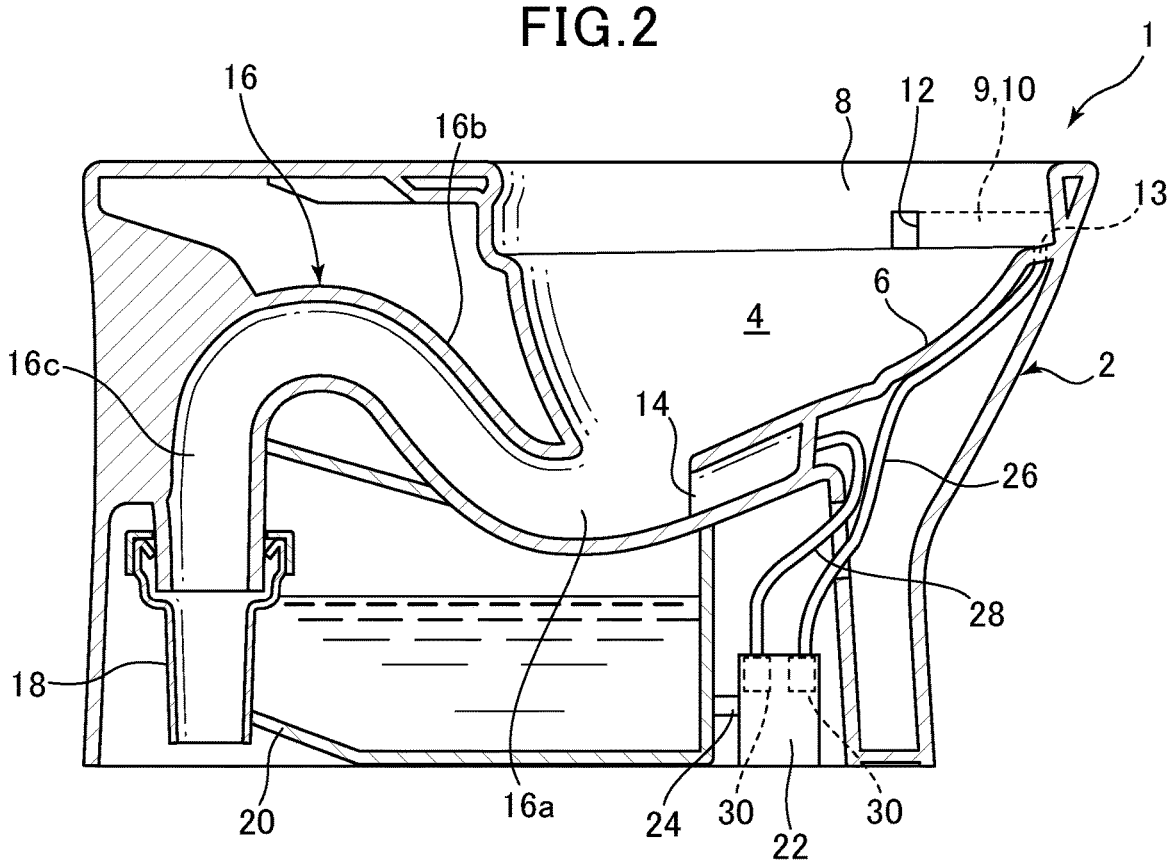
FIG. 2 is a sectional view taken along the line II-II in FIG. 1.

As depicted in FIG. 1, the flush toilet 1 according to this embodiment comprises a toilet main unit 2 placed on a floor. In the following description, a forward-rearward (longitudinal) direction of the flush toilet 1 is defined on an assumption that the right side and the left side in FIG. 1 correspond, respectively, to forward side and rearward side, and a rightward-leftward (lateral) direction of the flush toilet 1 is defined on an assumption that the upper side and the lower side in FIG. 1 correspond, respectively, to rightward side and leftward side as viewed rearwardly by a user who stands in front of the flush toilet 1.

The toilet main unit 2 is a ceramic product having a glaze layer formed on a surface thereof, and comprises a bowl portion 4 for receiving waste. The bowl portion 4 has a bowl-shaped waste-receiving surface 6, and a rim 8 located along an upper edge of the waste-receiving surface 6. In the following description, a region of the bowl portion 4 forward of an central axis C extending in the lateral direction while passing through a longitudinal central position of the bowl portion 4, and a region of the bowl portion 4 rearward of the central axis C, will be referred to respectively as "front region" and "rear region".

The toilet main unit 2 has a rim spout section 9 for spouting flush water therethrough. The rim spout section 9 comprises a rim water-conducting passage 10, and a rim spout port 12 formed at a downstream end of the rim water-conducting passage 10, wherein the rim spout section 9 is configured to spout flush water from the rim spout port 12. The rim water-conducting passage 10 is provided inside a right-side part of the rim 8 located in the front region of the bowl portion 6, to extend over a relatively short distance, and the rim spout port 12 is formed at the downstream end of the rim water-conducting passage 10 to spout flush water therefrom. A bottom wall of the rim water-conducting passage 10 is formed with a connection opening 13 for allowing an aftermentioned first water-conducting hose 26 to be connected thereto. Both of the rim spout port 12 and the connection opening 13 are located in the front region of the bowl portion 6.

The rim spout section 9 is configured to spout flush water rearwardly from the rim spout port 12 so as to form a swirl flow swirling in a counterclockwise direction.

The bowl portion 4 has a jet spout port 14 formed in a bottom thereof. The jet spout port 14 is configured to spout flush water toward an inlet portion 16*a* of an aftermentioned drain trap conduit 16 to thereby generate siphonage.

The toilet main unit 2 further comprises a drain trap conduit 16 connected to the bowl portion 6 to drain waste therethrough. The drain trap conduit 16 has: an inlet portion 16*a* communicated with the bottom of the bowl portion 4, a trap rising conduit portion 16*b* extending upwardly from the inlet portion 16*a*, and a trap lowering conduit portion 16*c* extending downwardly from a downstream end of the trap rising conduit portion 16*b*. A drain socket 18 is provided on a downstream side of the trap lowering conduit portion 16 of the drain trap conduit 16, and an outlet of the trap lowering conduit portion 16*c* is connected to the drain socket 18 and further connected to a pipeline (not depicted) under the floor, via the drain socket 18.

The flush toilet 1 further comprises a water storage tank 20 for storing therein flush water to be supplied to the toilet main unit 2. In this embodiment, the water storage tank 20 is formed in an integral structure with the drain socket 18, and disposed beneath and on both sides of the drain trap conduit 16 inside the toilet main unit 2, which are typically an empty space. Alternatively, the water storage tank 20 may be disposed beneath, and/or on one of both sides of the drain trap conduit 16. That is, the water storage tank 20 may be disposed beneath, and/or on at least one of both sides of the drain trap conduit 16.

At a position inside the toilet main unit 2 and in front of the water storage tank 20, a booster pump 22 is disposed which is designed to supply the flush water stored in the water storage tank 20 to the toilet main unit 2. The booster pump 22 is connected to the water storage tank 20 via a connection hose 24 made of a resin material. Further, a first water-conducting hose 26 made of a resin material and configured to supply flush water to the rim spout port 12, and a second water-conducting hose 28 made of a resin material and configured to supply flush water to the jet spout port 14.

Further, on a discharge side of the booster pump 22, a check valve (one-way valve) 30 is provided which is designed to prevent a backflow of flush water in a direction from the first water-conducting hose 26 to the water storage tank 20, after deactivation of the booster pump 22. This check valve 30 is operable, even during deactivation of the booster pump 22, to enable the first water-conducting hose 26 to be filled with flush water to thereby reduce an amount of air remaining inside the first water-conducting hose 26. It should be noted that, even in the case where no check valve is provided, flush water remains inside the first water-conducting hose 26 at a level equal to a water surface of the water storage tank 20, during deactivation of the booster pump 22. Similarly, the second water-conducting hose 28 is provided with a check valve 30 which functions in the same manner as above.

Flush water to be stored in the water storage tank 20 is supplied from a water pipeline (not depicted) as a water supply source in a building. Then, flush water stored in the water storage tank 20 is supplied toward the toilet main unit 2 by the booster pump 22, and spouted from the water storage tank 20 and the jet spout port 14.

Next, with reference to FIG. 3, a connection structure between the rim water-conducting passage 10 and the first water-conducting hose 26 will be described.

Figure 3:
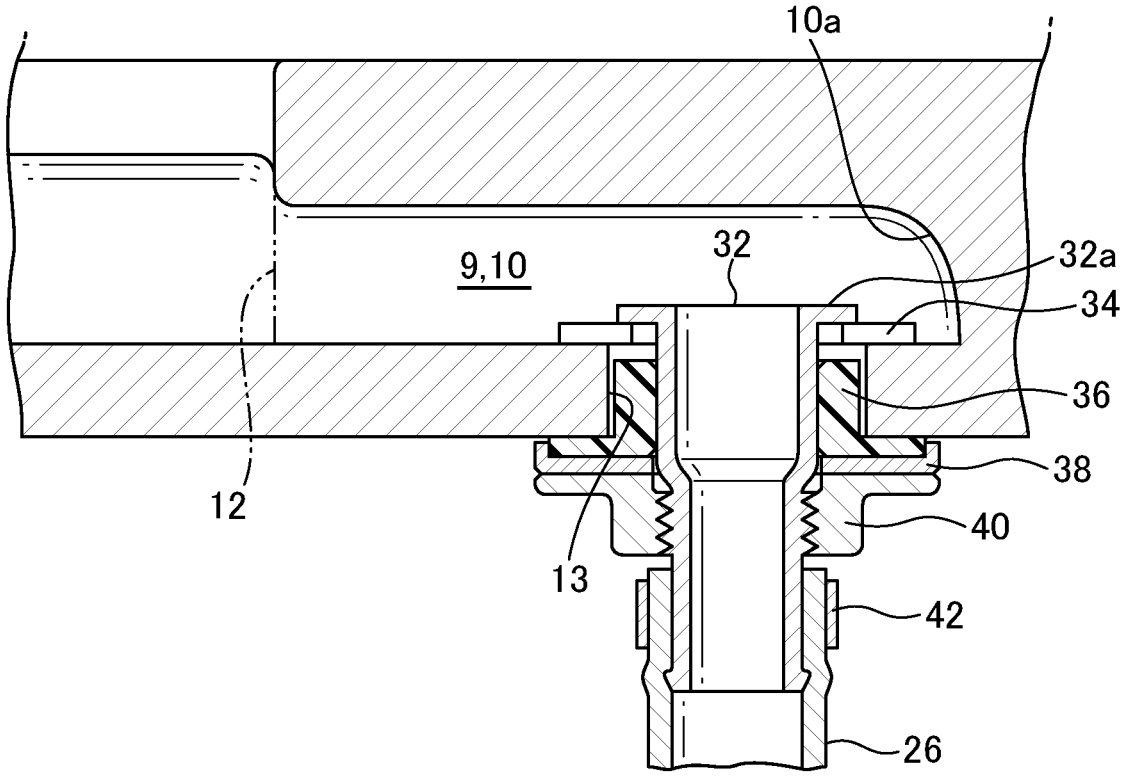
FIG. 3 is a fragmentary enlarged sectional view depicting a connection area between a rim water-conducting passage and a first water-conducting hose, taken along the line in FIG. 1.

As depicted in FIG. 3, the rim spout port 12 is located at the downstream end of the rim water-conducting passage 10, and the connection opening 13 is formed in the bottom wall of the rim water-conducting passage 10 to enable the rim water-conducting passage 10 to be connected to the first water-conducting hose 26. In vertical cross-section, the rim water-conducting passage 10 has a rising wall 10*a* located at an upstream end thereof and formed in an arc shape extending upwardly from the bottom wall of the rim water-conducting passage 10. This makes it possible for flush water flowing from the first water-conducting hose 26 into the rim water-conducting passage 10 to more effectively discharge air remaining inside the rim water-conducting passage 10, i.e., makes it less likely that the air is entrained in the flush water.

A connection method between the rim water-conducting passage 10 and the first water-conducting hose 26 will now be described. First of all, a connection pipe 32 is inserted into the connection opening 13 from below the rim water-conducting passage 10. Then, a plurality of sector stoppers 34 are inserted and interposed between a flange 32*a* of the connection pipe 32 and the bottom wall of the rim water-conducting passage 10. Then, a cross-sectionally L-shaped packing 36, a disk-shaped spacer 38 and a cross-sectionally inverted L-shaped nut 40 are inserted in this order from below the rim water-conducting passage 10. In this process, an internal thread of the nut 40 is engaged with an external thread of the connection pipe 32. As a result of the thread engagement between the nut 40 and the connection pipe 32, the packing 36 and the disk-shaped spacer 38 seal the connection opening 13, and the rim water-conducting passage 10 is fixed to the bottom wall of the rim water-conducting passage 10. Subsequently, an upper end, i.e., a downstream end, of the first water-conducting hose 26 is fitted onto a lower end of the connection pipe 32, and the first water-conducting hose 26 is fixed onto an outer peripheral surface of the connection pipe 32 by a hose clamp 42. In this way, operation of connecting the first water-conducting hose 26 to the rim water-conducting passage 10 is completed. A combination of at least the first water-conducting hose 26, the connection pipe 32 and the check valve 30 functions as a water-conducting passage member configured to supply flush water to the rim water-conducting passage 10 and to enable flush water to remain inside the rim water-conducting passage 10 during stop of supply of flush water.

Next, an operation of the flush toilet 1 according to this embodiment will be described.

When a user manually pushes a switch or the like to start a flushing operation, flush water stored in the water storage tank 20 is pressurized by the booster pump 22 and supplied to the rim water-conducting passage 10 through the first water-conducting hose 26.

The flush water supplied to the rim water-conducting passage 10 is conducted toward the rim spout port 12 while agitating air inside the rim water-conducting passage 10, and spouted from the rim spout port 12 rearwardly along an inner peripheral surface of the rim 8. The spouted flush water forms a swirl flow flowing on the waste-receiving surface 6 in a counterclockwise direction to clean the waste-receiving surface 6.

After a while, the supply of flush water to the first water-conducting hose 26 is stopped. At this time, the check valve 30 provided in the booster pump 22 functions to enable flush water to remain in the first water-conducting hose 26. Then, flush water is supplied from the booster pump 22 to the jet spout port 14 through the second water-conducting hose 28, and spouted from the jet spout port 14.

Next, advantageous effects obtainable by the flush toilet 1 according to this embodiment will be described.

In the flush toilet 1 according to this embodiment, the rim spout port 12 is provided in a part of the rim 8 located in the front region of the bowl portion 4, the flush water is spouted from the rim spout port 12, the spouted flush water swirls along the rim 8 to thereby clean the waste-receiving surface 6 of the bowl portion 4. The rim water-conducting passage 10 is provided inside a part of the rim 8 located in the front region of the bowl portion 4, to conduct flush water to the rim spout port 12. The first water-conducting hose 26 is configured to supply flush water to the upstream end of the rim water-conducting passage 10 located in the front region of the bowl portion 4, via a space beneath the waste-receiving surface 6 of the bowl portion 4, and the check valve 30 is configured to enable flush water to remain inside the first water-conducting hose 26 during stop of the supply of flush water. Thus, it is possible to shorten the length of the rim water-conducting passage 10 and thus suppress restrictions on flexibility in structural design and aesthetic design of the rim 8. Therefore, it is possible to suppress an influence of the structure of the rim 8 on flexibility in structural design and aesthetic design of the entire flush toilet 1. Further, for example, as compared to the case where the rim water-conducting passage extends inside the rim 8 in the range from the rear region of the bowl portion 4 to the front end of the bowl portion 4, the rim water-conducting passage 10 becomes shortened, so that it is possible to reduce an amount of air inside the rim water-conducting passage 10 and thereby suppress the occurrence of abnormal noise due to separation of air which has been entrained in flush water during a flushing operation.

In the flush toilet 1 according to this embodiment, the water storage tank 20 is disposed on both sides of and beneath the drain trap conduit 16 which are typically an empty space, so that it is possible to enhance flexibility in structural design and aesthetic design of the entire flush toilet 1. Further, as compared to the case where the water storage tank 20 is provided behind the bowl portion 4, the water storage tank 20 can be disposed at a position closer to the rim water-conducting passage 10, so that it is possible to further shorten the first water-conducting hose 26, and thus suppress the occurrence of abnormal noise due to air inside the first water-conducting hose 26.

In the flush toilet 1 according to this embodiment, the water storage tank 20 is provided in integral relation with the drain socket 18 for connecting the outlet of the drain trap conduit 16 to the external pipeline (not depicted), so that a clearance gap between the water storage tank 20 and the drain socket 18 is reduced. Thus, it is possible to more effectively utilize an empty space located on both sides of and beneath the drain trap conduit 16, and enhance the flexibility in structural design and aesthetic design of the entire flush toilet 1.

In the flush toilet 1 according to this embodiment, the downstream end of the first water-conducting hose 26 is connected to the bottom of the rim water-conducting passage 10, and the first water-conducting hose 26 is disposed to supply flush water into the rim water-conducting passage 10 in an upward direction, so that air inside the rim water-conducting passage 10 can be agitated by the flush water supplied from the first water-conducting hose 26. This makes it possible to more effectively suppress the occurrence of abnormal noise due to separation of air, in the rim water-conducting passage 10.

Although the present invention has been described based on the above embodiment, it is to be understood that various changes and modifications may be made therein. For example, instead of providing the water storage tank 20 and the booster pump 22, flush water may be supplied directly from a water pipeline to the rim water-conducting passage 10 through the first water-conducting hose 26, by utilizing a water feeding pressure.

What is claimed is:

1. A flush toilet which discharges waste by causing swirling of flush water, comprising:

a bowl portion having a bowl-shaped waste-receiving surface and a rim provided along an upper edge of the waste-receiving surface;

a drain conduit connected to the bowl portion to drain the waste therethrough;

a rim spout section including a rim water-conducting passage provided inside a part of the rim located in a front region of the bowl portion, and a rim spout port located at a downstream end of the rim water-conducting passage for horizontally spouting the flush water therefrom so as to cause the spouted flush water to swirl along the rim to thereby clear the bowl portion, the rim water-conducting passage having a predetermined length and an opening on a bottom surface of an upstream end thereof, both of the rim spout port and the opening of the rim water-conducting passage being located in the front region of the bowl portion, the rim water-conducting passage being a closed flow path except for the rim spout port located at the downstream end thereof and the opening located at the upstream end thereof; and a water-conducting passage member connected from below the waste-receiving surface to the opening of the rim water-conducing passage so as to supply the flush water to the rim water-conducting passage, the water-conducting passage member being configured to enable flush water to remain therein when flush water is no longer supplied, wherein the water-conducting passage member is contained within a periphery of the waste-receiving surface in a plan view.

2. The flush toilet according to claim 1, wherein the flush toilet further comprises: a water storage tank disposed on at least one side of the drain conduit or beneath the drain conduit, to store flush water therein; and a booster pump for supplying the flush water stored in the water storage tank to the water-conducting passage member.

3. The flush toilet according to claim 2, wherein the flush toilet further comprises a drain socket for connecting an outlet of the drain conduit to an external pipeline, wherein the water storage tank is provided in integral relation with the drain socket.

4. The flush toilet according to claim 1, wherein the water-conducting passage member has a downstream end connected to the bottom surface of the rim water-conducting passage, the water-conducting passage member being disposed to supply the flush water into the rim water-conducting passage in an upward direction.

* * * * *